United States Patent [19]

Siczek

[11] Patent Number: 4,503,844

[45] Date of Patent: Mar. 12, 1985

[54] SURGICAL TABLE

[75] Inventor: Benard W. Siczek, La Grange Park, Ill.

[73] Assignee: Fischer Imaging Corporation, Denver, Colo.

[21] Appl. No.: 457,644

[22] Filed: Jan. 13, 1983

[51] Int. Cl.[3] ..... A61G 7/06

[52] U.S. Cl. ..... 128/71; 5/11

[58] Field of Search ..... 128/68, 70–75, 128/61, 44; 5/63–69, 70, 79, 131, 11; 269/322–326; 297/283–285; 280/43, 43.17, 43.2

[56] References Cited

U.S. PATENT DOCUMENTS

| | | | |
|---|---|---|---|
| 2,188,592 | 1/1940 | Cunningham | 5/61 |
| 2,492,406 | 12/1949 | Thomas | 128/33 |
| 2,682,153 | 6/1954 | Fink, Sr. | 280/43.23 X |
| 2,722,929 | 11/1955 | Little | 128/33 |
| 3,305,876 | 2/1967 | Hutt | 280/43.23 X |
| 3,584,321 | 6/1971 | Buchanan | 5/62 X |
| 3,802,002 | 4/1974 | Jonas | 5/64 |
| 4,097,939 | 7/1978 | Peck et al. | 5/63 |
| 4,153,293 | 5/1979 | Seldon | 297/284 |
| 4,207,635 | 6/1980 | Leroy | 5/62 X |

FOREIGN PATENT DOCUMENTS

| | | | |
|---|---|---|---|
| 905059 | 9/1962 | United Kingdom | 280/43.2 |
| 1468255 | 3/1977 | United Kingdom | 5/63 R |

*Primary Examiner*—Robert A. Hafer
*Assistant Examiner*—Chris Coppens
*Attorney, Agent, or Firm*—Willian, Brinks, Olds, Hofer, Gilson & Lione, Ltd.

[57] ABSTRACT

A surgical table is disclosed which includes a base and a first planar table surface which is fixedly mounted to the base. A second planar table surface is mounted to the base by means of a linear guide such that the second table surface is positioned in the plane of the first table surface and is movable toward and away from the first table surface. A third table surface is interconnected between the first and second table surfaces. This third table surface is formed of a bendable material and is provided with a cylindrically convex shape. The radius of curvature of this convex shape varies as a function of the linear position of the first table surface with respect to the second table surface. Preferably, the third table surface is formed of an X-ray transparent material. Articulated leg brackets allow the height and tilt angle of the table to be adjusted. The disclosed surgical table is particularly useful in positioning the spine of a patient as necessary for certain surgical procedures in which a needle must be inserted into a disc between two adjacent vertebra.

14 Claims, 8 Drawing Figures

FIG. 2
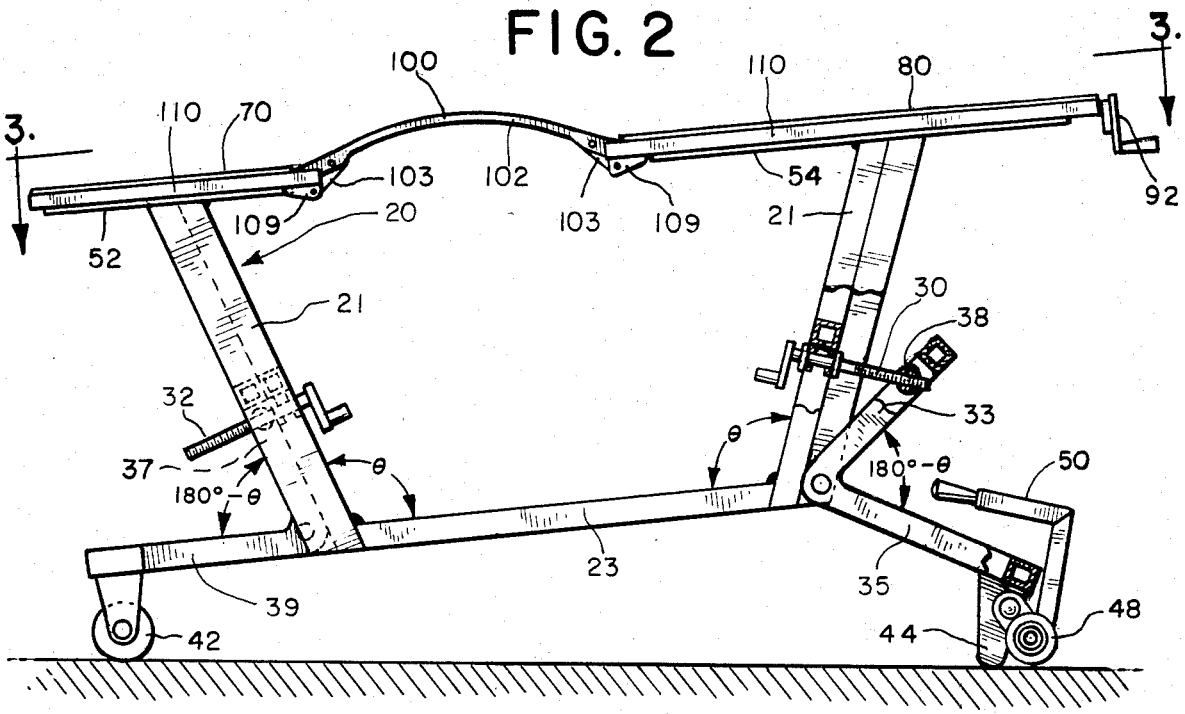
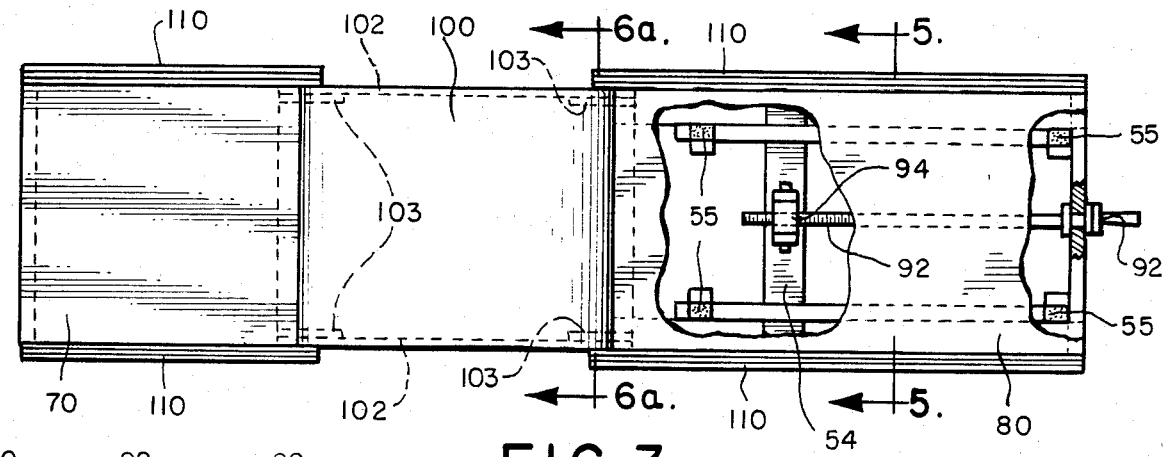
FIG. 3
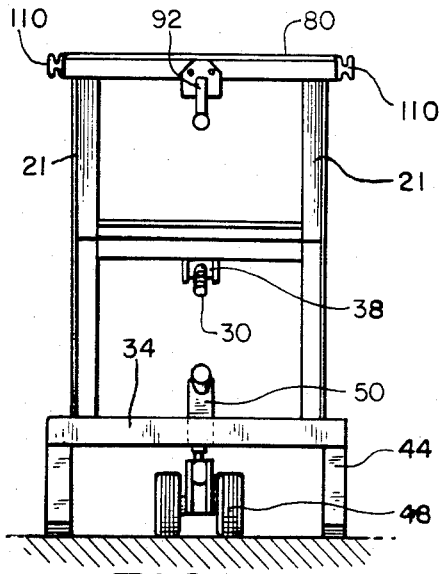
FIG. 4

SURGICAL TABLE

BACKGROUND OF THE INVENTION

This invention relates to a surgical table which can be positioned to facilitate surgical procedures.

Chymopapain is an injectable drug which has come to be used as an alternative to surgery in treating herniated lower back discs when more conservative measures such as bed rest and traction have failed. Chymopapain is intended to be injected into a herniated disc in a hospital setting. In practice, a patient is positioned on his side on a table, and then supports are placed under the side of the patient as necessary to position the spine properly in order to allow the insertion of a needle into the herniated disc between adjacent lumbar vertebra. Typically, the needle insertion process is performed while a fluoroscope is used to monitor the position of the needle and of the adjacent vertebra.

In the past, fixed humps and readily available supports such as pillows, towels and the like have been used to position the spine of the patient into the desired position. These approaches have not proved entirely satisfactory. A fixed hump cannot be adjusted in a progressive manner to accommodate the differing curvatures needed for different patients. Readily available supports can move in use, and they cannot be progressively and gradually adjusted in a simple and controllable manner.

Thus, a need presently exists for a surgical table that can be shaped and positioned as needed to position the spine of a patient correctly for surgical procedures, such as the injection of Chymopapain or other enzymes as described above.

SUMMARY OF THE INVENTION

An important object of the present invention is to provide an improved surgical table having a curved portion, wherein the curvature of this curved portion can be adjusted as necessary to position a patient as desired.

According to this aspect of the invention, a surgical table is provided which includes a base which defines first and second spaced supports. A first table surface is mounted to the first support, and a linear guide which comprises a first guide member is mounted to the second support. The linear guide also includes a second guide member which is guided for linear travel toward and away from the first table surface by the first guide member. A coupling arrangement is provided which is operative to adjust the linear position of the first guide member with respect to the second guide member. The second guide member defines a second table surface. A third table surface is interconnected between the first and second table surfaces. This third table surface is formed of a bendable material which defines a convex shape, the radius of curvature of which varies as a function of the linear position of the first guide member with respect to the second guide member. Thus, by adjusting the linear position of the second table surface, the shape of the third table surface can be adjusted as desired.

A further object of this invention is to provide a surgical table which can readily be adjusted for height and tilt angle in a simple and reliable manner. This feature of the invention, though usable in conjunction with the features described above, can also be used independently in surgical tables which utilize standard, fixed table surfaces.

According to this aspect of the invention, a surgical table is provided which comprises a table surface and a frame mounted to support the table surface. The frame defines first and second spaced pivot axes, and first and second leg brackets are provided. Each of the leg brackets comprises a respective contact member for contacting a support surface on which the table rests in order to support the leg bracket above the table surface. Means are provided for pivotably mounting the first and second leg brackets to the first and second pivot axes of the frame, respectively, such that the frame is supported above its support surface by the contact members. In addition, means are provided for adjusting the angular position of the first and second leg brackets with respect to the frame about the first and second pivot axes, respectively. The leg brackets, mounting means, and adjusting means cooperate to control and adjust the height of the table surface above the support surface and the tilt angle of the table surface with respect to the support surface.

The preferred embodiment of this invention described below provides a number of important advantages. The curved table surface can be adjusted as to curvature and height in a controlled and progressive manner. This allows the surgeon using the table to position the spine of the patient as desired in a simple and easy manner. The curved table surface can be lowered such that the surgical table can be used substantially in the manner of a standard surgical table. Preferably, the curved table surface is formed of an X-ray transparent material and the table is configured such that a fluoroscope can be positioned with an X-ray source either above or below the curved table surface and an X-ray sensor positioned to sense X-rays which have passed through the curved table surface and the patient. The articulated leg brackets of this invention can be used symetrically to raise or lower the level of the table to vary its working height. In addition, the leg brackets can be positioned asymetrically to vary the tilt angle of the table, as for example when it is desired to place a patient in a head-down attitude.

The surgical table of this invention has been found to facilitate the injection of Chymopapain as described above, and to allow such surgical procedures to be carried out in a simple and dependable manner.

The invention itself, together with further objects and attendant advantages, will best be understood by reference to the following detailed description taken in conjunction with the accompanying drawings.

BRIEF DESCRIPTION OF THE DRAWINGS

FIG. 2 is a side view in partial cutaway of the surgical table of FIG. 1 showing one of the leg brackets tilted.

FIG. 3 is a top view in partial cutaway of the surgical table of FIG. 1.

FIG. 4 is an end view of the surgical table of FIG. 1.

FIG. *6a* is a sectional view taken along line *6a—6a* of FIG. 3.

FIG. *6b* is an enlarged side view taken along line *6b—6b* of FIG. *6a* showing the manner in which the central table section is attached to one of the end table surfaces.

Figure 1:
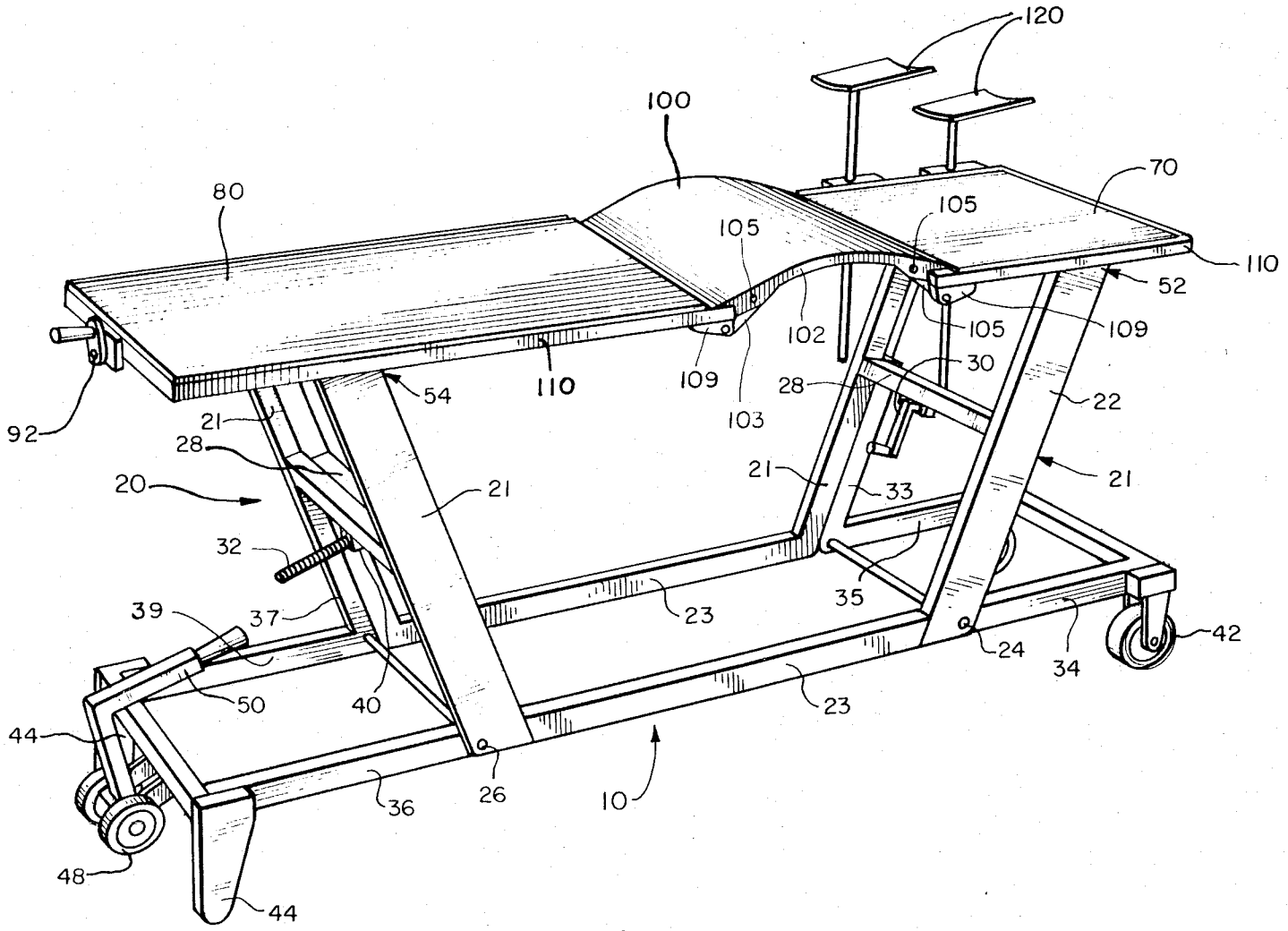
FIG. 1 is a perspective view of a presently preferred embodiment of the surgical table of this invention.
Figure 7:
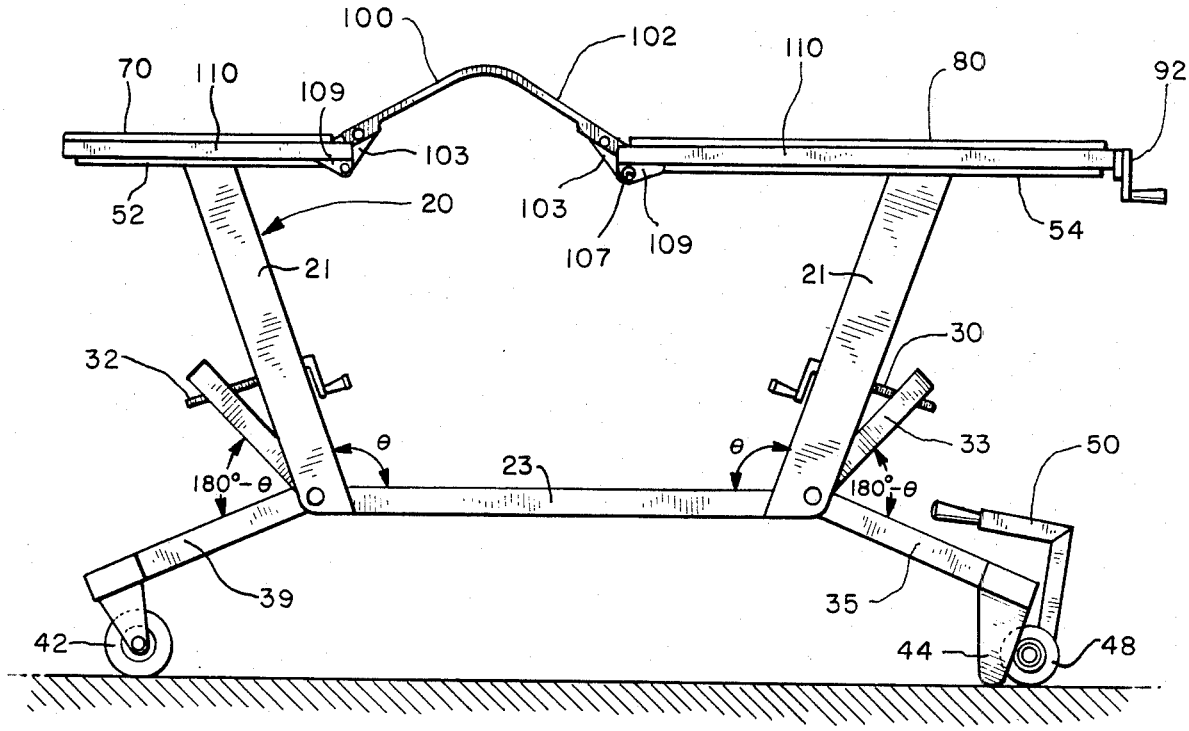

FIG. 7 is a side elevational view of the surgical table of FIG. 1 showing the leg brackets of the table pivoted downwardly to raise the uppermost surface of the table and showing the center table surface in a position more elevated than that shown in FIG. 2.

DETAILED DESCRIPTION OF THE PRESENTLY PREFERRED EMBODIMENTS

Turning now to the drawings, FIGS. 1 through 7 show various views of the presently preferred embodiment of the surgical table 10 of this invention. As shown in FIGS. 1 and 2, this surgical table 10 includes a rigid base 20. This base 20 is made up of a frame 22 which includes side frame members 21 and lower frame members 23, and which defines first and second lower pivots 24, 26. Cross bars 28 interconnect the two sides of the frame 22, and each of the cross bars 28 serves to mount a respective lead screw 30, 32. A first leg bracket 34 is mounted by means of the first lower pivot 24 to the frame 20, and a second leg bracket 36 is mounted by means of the second lower pivot 26 to the frame 22. Each of the leg brackets 34, 36 includes an upper leg segment 33, 37 and a lower leg segment 35, 39 which extend radially from the respective pivots 24, 26.

Each of the leg brackets 34, 36 defines a respective follower 38, 40, and the followers 38, 40 are engaged in the respective lead screws 30, 32. Thus, by manually rotating the lead screws 30, 32, the respective leg brackets 34, 36 can be pivoted with respect to the frame 22 about the respective pivots 24, 26. In this way, the frame 22 can be tilted, raised or lowered as desired. For example, FIG. 1 shows the table 10 in a lowered, horizontal position, FIG. 2 shows the table 10 in a tilted position, and FIG. 7 shows the table 10 in a raised, horizontal position.

As shown in FIG. 2, in this embodiment the angle between the side and lower frame members 21, 23 is equal to $\theta$, an angle greater than 90°, and the angle between the upper and lower leg segments 33, 37 and 35, 39 is equal to $180°-\theta$. Thus, the lower leg segments 35, 39 are co-linear with the lower frame members 23 when the leg brackets are adjusted to their lowered positions.

The first leg bracket 34 serves as a mounting bracket for two fixed wheels 42. Two fixed legs 44 are similarly mounted to the second leg bracket 36. In addition, a pair of movable wheels 48 are pivotably mounted to the second leg bracket 36, and are provided with a handle 50. When the moveable wheels 48 are in the position shown in FIG. 1, the weight of the surgical table 10 is borne in large part by the fixed legs 44, which prevent the table 10 from moving on its support surface. When it is desired to move the surgical table 10, the handle 50 is used to pivot the moveable wheels 48 such that the movable wheels 48 support the second leg bracket 36, and the fixed legs 44 are raised out of contact with the support surface. In this position, the entire weight of the surgical table 10 is supported by the wheels 42 and 48, and the table 10 can be rolled into position.

The frame 22 defines first and second supports 52, 54 at its upper end. In this preferred embodiment, the first and second supports 52, 54 each take the form of two parallel rails. The rails 56 of the second support 54 function as linear guide members as explained below.

The surgical table 10 includes a first table surface 70 which is fixedly mounted to the first support 52 such that the first table surface 70 is prevented from moving with respect to the frame 22.

Figure 5:
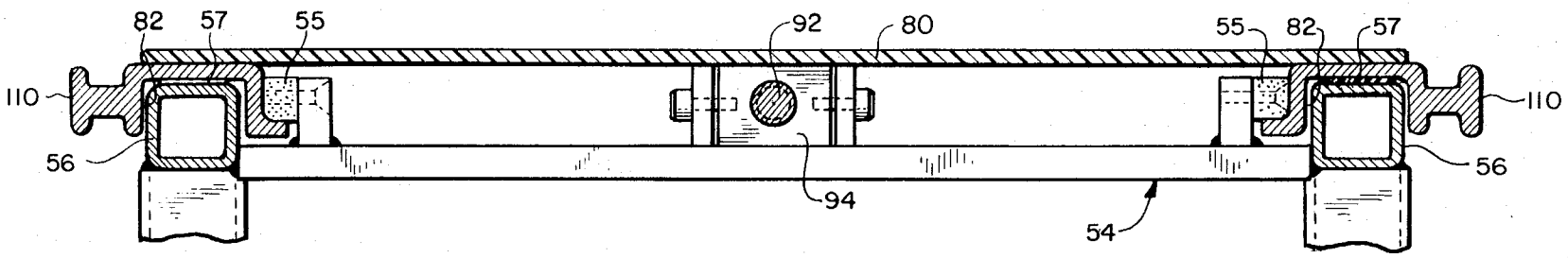
FIG. 5 is a sectional view taken along 5—5 of FIG. 3.

The table 10 also includes a second support surface 80 which is slideably mounted on the rails 56 of the first support, as best shown in FIG. 5. U-shaped channels 82 mounted to the second table surface 80 serve as second guide members which cooperate with the rails 56 of the support 54 to form a linear guide. This linear guide is oriented such that the first and second table surfaces 70, 80 are co-planar, and the second table surface 80 is allowed to move through a limited range of travel in a linear movement toward and away from the first table surface 70. Nylon guide blocks 55 are rotatably mounted to the support 54 to position the second table surface 80 laterally. A low friction strip 57 of material, such as Teflon, is interposed between the rails 56 and the channels 82 to allow the second table surface to slide smoothly on the rails 56.

The position of the second table surface 80 with respect to the frame 22 is controlled by a coupling arrangement 90. This coupling arrangement 90 includes a lead screw 92 which is rotatably mounted by means of thrust bearings to the second table surface 80 and is threadedly engaged with a follower 94 mounted between the rails 56 of the second support 54. The lead screw 92 is provided with a manually operated handle, such that a user can rotate the lead screw 92 by rotating its handle. When the lead screw 92 is rotated, it moves through the follower 94, thereby moving the second table surface 80 with respect to the frame 22 in the linear guide formed by the channels 82 and the rails 56. Thus, by manually rotating the handle of the lead screw 92, the second table surface 80 can be made to approach the first table surface 70 or to move away from the first table surface 70.

A third table surface 100 is mounted between the adjacent ends of the first and second table surfaces 70, 80. This third table surface 100 defines a cylindrically convex shape, with the cylindrical axis in a plane parallel to the plane of the first and second table surfaces 70, 80 and perpendicular to the direction of travel of the second table surface 80. Preferably, this third table surface 100 is formed of an X-ray transparent material such as a plastic. In the presently preferred embodiment, a plastic such as Lexan or Tuffak-Am available from the Rohm and Haas Co. has been found to be suitable. In particular, the physical properties of the presently preferred material for the third table surface 100 are as follows: Ultimate Tensile Strength per ASTM D638-9500 p.s.i.; Elongation per ASTM D638-110%; Compressive Strength per ASTM D695-12,500 p.s.i.; Flexural Strength per ASTM D790-13,500 p.s.i.; Modulus of Elasticity per ASTM D638-345,000 p.s.i.

Figure 6A:
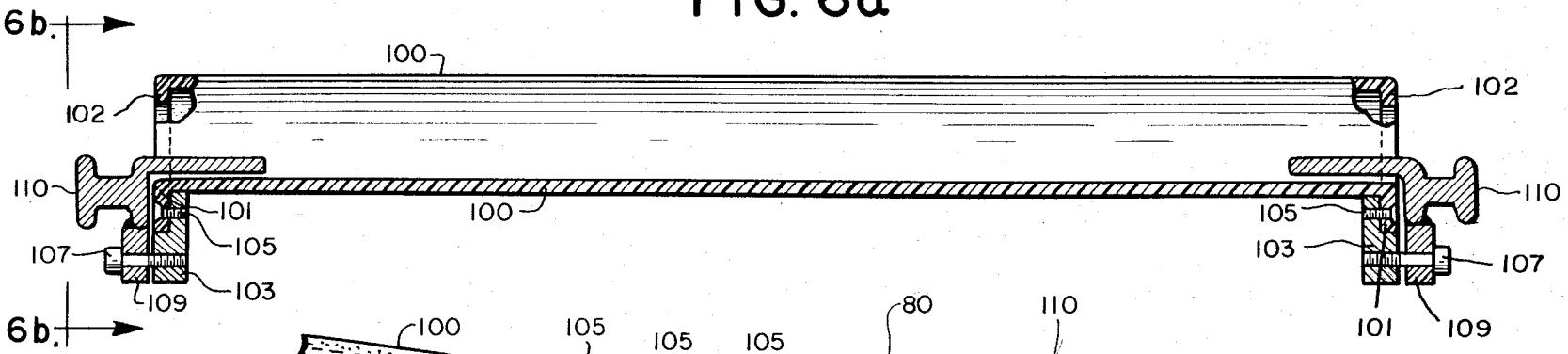
Figure 6B:
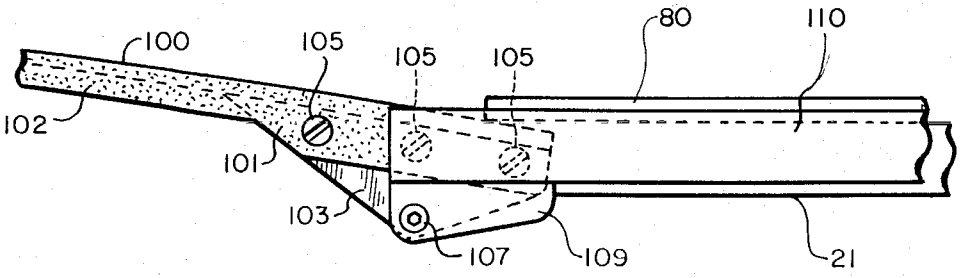

As best shown in FIGS. 6*a* and 6*b*, the third table surface 100 of this embodiment is formed of a one quarter inch thick plastic sheet which has an integrally formed side rail 102 folded down at each side and an integrally formed bracket 101 folded down at each corner. Each bracket 101 is mounted to a respective pivot plate 103 by three fasteners 105. Each pivot plate 103 is pivotably mounted by a fastener 107 to a respective lug 109, which is welded in place to the respective rail 110. As shown in FIG. 6*a*, the two fasteners 107 on each side are co-linear, and thus the third table surface 100 is mounted at each end to one of the first and second table surfaces 70, 80 to pivot about a respective axis.

The third table surface 100 is mounted to the first and second table surfaces 70, 80 such that the three table surfaces 70, 80, 100 form a substantially continuous table surface for the surgical table 10. The length of the third table surface 100 is chosen such that when the second table surface 80 is moved as far away from the first table surface 70 as allowed by the lead screw 92, the third table surface 100 is still provided with an upwardly convex shape as shown in FIG. 2. In this preferred embodiment, the third table surface 100 never approaches the plane of the first and second table surfaces 70, 80 more closely than about 1.75 inches at its center. In this way, the third table surface 100 remains structurally strong enough to support a patient.

A rail 110 is formed along both sides of both the first and second table surfaces 70, 80. This rail 100 can be used to clamp any desired type of accessory to the table 10. For example, leg supports 120 as shown in FIG. 1 can be clamped at appropriate positions on the rail 110 of the first table surface 70 in order to assist in positioning the patient properly for the desired surgical procedure.

Any suitable materials and construction techniques can be used to build the table 10. Stainless steel or enameled metal can be used for exposed surfaces, and standard engineering techniques can be used to choose dimensions and structure to provide the required strength.

Having described the structure of this preferred embodiment, its operation can now be described in detail. In use, it is often preferable to start a surgical procedure with the third table surface 100 in the lower position shown in FIG. 2 in order to facilitate moving a patient onto the table. The patient is then positioned on the table 10 on his side, with his waist over the third table surface 100. The lead screws 30, 32 can be used to raise the plane of the first and second table surfaces 70, 80, as shown in FIG. 7. Furthermore, if desired the lead screws 30, 32 can be used to position the leg brackets 34, 36 asymmetrically in order to tilt the plane of the first and second table surfaces 70, 80 out of the horizontal plane, as shown in FIG. 2.

Once the patient has been positioned as described above, the lead screw 92 can be rotated to cause the second table surface 80 to move toward the first table surface 70. When this happens, the third table surface 100 is caused to bend upwardly, out of the plane of the first and second table surfaces 70, 80. That is, the radius of curvature of the third table surface 100 is reduced, thereby causing the spine of the patient positioned on the table to be deflected upwardly in the region of the third table surface 100. In this preferred embodiment, the third table surface 100 can be deflected sufficiently to cause the central portion of the third table surface 100 to rise to a distance of about eight inches above the plane of the first and second table surfaces 70, 80.

Typically, the surgical procedure of inserting a needle into a herniated disc will be performed while the position of the needle is monitored by means of a fluoroscope which includes either an X-ray source or an X-ray sensor which is positioned immediately below the third table surface 100, with the other of these components positioned above the patient so as to cause X-rays which have passed through the patient and the third table surface 100 to be detected. When the surgical procedure is over, the lead screw 92 can be rotated to lower the third table surface 100, and the handle 50 can be used to pivot the moveable wheels 48 to allow the table 10 to be rolled out of the operating room.

From the foregoing discussion, it should be apparent that the surgical table of this invention provides a number of important advantages. Because the third table surface 100 is X-ray transparent, and because the third table surface 100 forms the only attachment between the first and second table surfaces 70, 80 near the plane of the first and second table surfaces 70, 80, a clear fluoroscopic image can be obtained without interference from the table 10. Since the height, tilt angle, and curvature of the third table surface 100 can readily be adjusted in a controlled and progressive manner, the table 10 of this invention can be used to allow a surgeon to position the spine of a patient as desired in a simple, reliable and controllable manner. The table disclosed above is excellently adapted to allow a fluoroscope to be positioned to provide an undisturbed view of the surgical procedure. Furthermore, the third table surface 100 can be lowered to facilitate the movement of a patient onto the table 10 or to allow the surgical table 10 to be used substantially as a standard surgical table. The entire table 10 is manually operated, and it can readily be locked in position as desired.

It should be understood that the present invention is not limited to the precise structure described above. Rather, a wide range of modifications can be made to this table without departing from the spirit of the invention. For example, a wedge arrangement, a worm gear arrangement, or even a cable and pulley arrangement can be substituted for the lead screws 30, 32 or 92. The present invention is not directed to any particular type of guide or positioning system for the second table surface 80. Rather, the widest variety of guides and positioning systems can be adapted for use with this invention.

Furthermore, the preferred embodiment described above has been adapted for use with fluoroscopic monitoring of the surgical procedure. If other monitoring techniques (such as NMR imaging or ultrasound imaging techniques) are used, the material of the curved table top 100 can be adapted as necessary to allow the relevant portion of the patient's anatomy to be visualized. Thus, sonically transparent or NMR transparent materials may be preferable in some applications. Moreover, the present invention is not limited to use in free-standing bases of the type described above. Rather, the base can be formed by another table or a bed to which the guide and the table surfaces are attached. In this way, a more compact and portable surgical table can be provided.

Thus, a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

I claim:

1. A surgical table comprising:

a base which defines first and second spaced supports;

a first table surface mounted to the first support;

a linear guide comprising a first guide member mounted to the second support, a second guide member guided for linear travel along the first guide member toward and away from the first table surface, and a coupling arrangement operative to adjust the linear position of the first guide member with respect to the second guide member, said second guide member defining a second table surface; and a third X-ray transparent table surface interconnected between the first and second table surfaces, said third table surface being formed of a bendable material and having a convex shape, the curvature of which varies as a function of the linear position of the first guide member with respect to the second guide member.

2. The invention of claim 1 wherein the third table surface is formed of a plastic material.

3. The invention of claim 1 wherein the first and second table surfaces are co-planar and wherein the third table surface extends above the plane of the first and second table surfaces by an amount that increases as a direct function of the degree of curvature of the third table surface.

4. The invention of claim 1 wherein the coupling arrangement comprises a lead screw coupled to one of the first and second guide members and a follower mounted to the other of the first and second guide members and coupled to the lead screw to move along the lead screw when the lead screw is rotated.

5. A surgical table comprising:

a base;

a first table surface mounted to a first portion of the base;

a second table surface;

means for mounting the second table surface to the base such that the second table surface is movable toward and away from the first table surface and can be held in any one of a plurality of positions;

a bendable third table surface mounted between the first and second table surfaces, said third table surface being X-ray transparent and having a curved shape, the degree of curvature of which is controlled by the position of the second table surface with respect to the base such that the shape of the third table surface can be adjusted by adjusting the position of the second table surface with respect to the base.

6. The invention of claim 5 wherein the third table surface is formed of a plastic material.

7. The invention of claim 5 wherein the first and second table surfaces are co-planar and wherein the third table surface extends above the plane of the first and second table surfaces by an amount that increases as a direct function of the degree of curvature of the third table surface.

8. The invention of claim 7 wherein the third table surface forms the only interconnection between the first and second table surfaces near the plane of the first and second table surfaces.

9. The invention of claim 5 wherein the mounting means comprises:

a first guide member mounted to the base;

a second guide member guided for linear travel by the first guide member, said second guide member defining the second table surface;

a lead screw coupled to one of the first and second guide members; and a follower coupled to the other of the first and second guide members and coupled to move along the lead screw when the lead screw is rotated.

10. A surgical table comprising:

a base having first and second pairs of fixedly mounted legs;

a planar first table surface fixedly mounted to the first pair of legs;

a linear guide fixedly mounted to the second pair of legs in a plane parallel to that of the first table surface;

a planar second table surface mounted to the linear guide to slide in the plane of the first table surface along a first direction, toward and away from the first table surface;

means for adjusting the position of the second table surface in the linear guide;

a bendable, X-ray transparent, third table surface mounted between the first and second table surface, said third table surface having a cylindrically convex upward shape, the cylindrical axis of which extends in a plane parallel to that of the first and second table surfaces, perpendicular to the first direction, the degree of curvature of the third table surface varying with the position of the second table surface in the linear guide such that at least a central portion of the third table surface extends above the plane of the first and second table surfaces by an adjustable amount.

11. The invention of claim 10 wherein the third table surface is formed of a plastic material.

12. The invention of claim 10 wherein the third table surface forms the only interconnection between the first and second table surfaces near the plane of the first and second table surfaces.

13. The invention of claim 10 wherein the adjusting means comprises a lead screw coupled to one of the linear guide and the second table surface and a follower coupled to the other of the linear guide and the second table surface and coupled to move along the lead screw when the lead screw is rotated.

14. The invention of claim 10 further comprising:

means for defining a first pivot axis at a lower portion of the first pair of legs;

means for defining a second pivot axis at a lower portion of the second pair of legs;

a first leg bracket which defines a first pivot point pivotably mounted to the base to pivot about the first axis; a first lower leg segment and a first upper leg segment extending radially from the first pivot point; and a first attachment bracket mounted to the first upper leg segment;

a second leg bracket which defines a second pivot point pivotably mounted to the base to pivot about the second axis; a second lower leg segment and a second upper leg segment extending radially from the second pivot point; and a second attachment bracket mounted to the second upper leg segment;

means, mounted on the first and second lower leg brackets, for contacting a support surface to support the base;

a first lead screw coupled between the base and the first attachment bracket to adjust and control the angular position of the first leg bracket with respect to the base; and a second lead screw coupled between the base and the second attachment bracket to adjust and control the angular position of the second leg bracket with respect to the base;

the base, leg brackets, and lead screws cooperating to vary and adjust the height of the first and second table surfaces above the support surface and the tilt angle of the first and second table surfaces with respect to the support surface.

* * * * *